US012515831B1

(12) United States Patent
Siegl et al.

(10) Patent No.: US 12,515,831 B1
(45) Date of Patent: Jan. 6, 2026

(54) METHOD FOR FILLING A PLASTIC CONTAINER

(71) Applicant: ALPLA WERKE ALWIN LEHNER GMBH & CO. KG, Hard (AT)

(72) Inventors: Robert Siegl, Dornbirn (AT); Oswald Valtiner, Bregenz (AT)

(73) Assignee: ALPLA WERKE ALWIN LEHNER GMBH & CO. KG, Hard (AT)

( * ) Notice: Subject to any disclaimer, the term of this patent is extended or adjusted under 35 U.S.C. 154(b) by 0 days.

(21) Appl. No.: 19/117,433

(22) PCT Filed: Oct. 6, 2023

(86) PCT No.: PCT/EP2023/077689

§ 371 (c)(1),
(2) Date: Apr. 1, 2025

(87) PCT Pub. No.: WO2024/074671

PCT Pub. Date: Apr. 11, 2024

(30) Foreign Application Priority Data

Oct. 6, 2022 (CH) ..... 001172/2022

(51) Int. Cl.
*B65B 3/04* (2006.01)
*B65B 3/18* (2006.01)
*B65B 7/00* (2006.01)

(52) U.S. Cl.
CPC . *B65B 3/18* (2013.01); *B65B 7/00* (2013.01)

(58) Field of Classification Search
CPC .... B65B 3/18; B65B 3/04; B65B 7/00; B67C 3/223; B67C 2003/226
See application file for complete search history.

(56) References Cited

U.S. PATENT DOCUMENTS 3,945,174 A * 3/1976 Franz ..... B67B 3/00 53/317
4,926,613 A * 5/1990 Hansen ..... B65B 3/18 53/433

(Continued)

FOREIGN PATENT DOCUMENTS

CN 102271896 B * 10/2014 ..... B65B 61/24
EP 1052216 A1 * 11/2000 ..... B67C 3/223
FR 2967973 A1 6/2012

OTHER PUBLICATIONS

International Search Report issued by the European Patent Office acting as the International Searching Authority in relation to International Application No. PCT/EP2023/077689 dated Jan. 24, 2024 (3 pages) along with English language translation (2 pages).

(Continued)

*Primary Examiner* — Andrew M Tecco
(74) *Attorney, Agent, or Firm* — Robert P. Michal, Esq.; Rimôn PC

(57) ABSTRACT

A method for filling a plastics container, wherein an excess pressure is built up in the filled and closed container. The method includes the following method steps: filling the plastics container with a liquid, and closing the filled plastics container. In a deformation step, the container, prior to being closed, is deformed by a mechanical force such that the cross-sectional shape of the container is changed and its volume is thereby increased. In a pressure relief step, the mechanical force is removed once the container has been closed, as a result of which the volume contraction causes an excess pressure to build up in the container, and the filling height of the liquid increases.

8 Claims, 2 Drawing Sheets

(56) References Cited

U.S. PATENT DOCUMENTS

Figure 1:
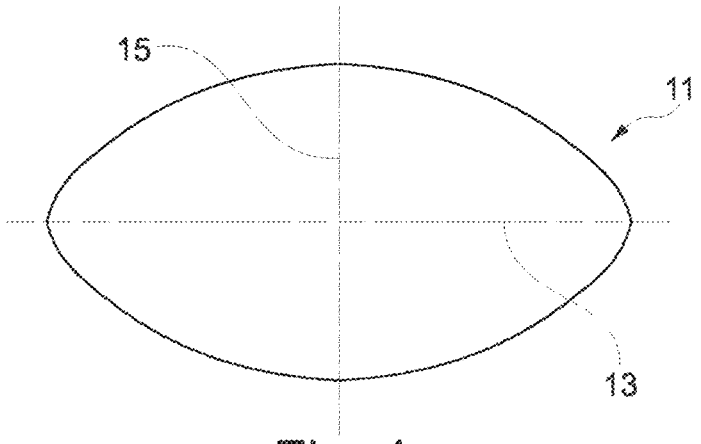

| | | | | |
|---|---|---|---|---|
| 7,744,365 | B2 * | 6/2010 | Maddox | B29C 49/62 425/522 |
| 9,561,947 | B2 * | 2/2017 | Krieg | B65D 51/16 |
| 9,802,730 | B2 * | 10/2017 | Melrose | B65B 3/022 |
| 10,266,298 | B2 * | 4/2019 | Denis | B29D 22/003 |
| 2014/0102042 | A1 * | 4/2014 | Krieg | B67C 3/223 53/403 |
| 2015/0047299 | A1 * | 2/2015 | John-Unterburger | B65D 1/0292 220/601 |
| 2016/0115008 | A1 * | 4/2016 | Bohen | B65B 7/00 215/381 |
| 2019/0233141 | A1 * | 8/2019 | John-Unterburger | B65B 3/04 |

OTHER PUBLICATIONS

Written Opinion of the International Searching Authority issued by the European Patent Office acting as the International Searching Authority in relation to International Application No. PCT/EP2023/077689 dated Jan. 24, 2024 (5 pages).

* cited by examiner

METHOD FOR FILLING A PLASTIC CONTAINER

CROSS-REFERENCE TO RELATED APPLICATIONS

This application is a national phase entry under 35 U.S.C. 371 of PCT International Application No. PCT/EP2023/077689 filed Oct. 6, 2023, which claims priority to Swiss Patent Application No. CH001172/2022 filed Oct. 6, 2022, the disclosure of each of these applications is expressly incorporated herein by reference in their entirety.

FIELD OF THE INVENTION

The invention relates to a method for filling a plastics container according to the preamble of independent claim.

PRIOR ART

PET bottles are perceived as either stiff and stable because the wall thickness is increased or because they have an internal pressure when filled and closed.

PET has a poor barrier against water and water vapor. As a result, even thick-walled containers quickly lose part of their contents. The missing water is noticeable by a vacuum in the bottle. The vacuum makes the bottles sensitive to external forces and they deform immediately. The consumer perceives such bottles as unstable. As the water loss progresses, the bottle collapses and ends up deformed and usually unsellable on the supermarket shelf.

PET bottles are therefore often provided with an artificial internal pressure. Nitrogen is preferably used for this purpose because nitrogen can be easily added to the filling material as a liquid droplet with a temperature of −195° C. and there is enough time to close the container before the droplet of nitrogen converts to gaseous nitrogen. When the nitrogen evaporates, internal pressure is generated in the bottle. This has made it possible to continually reduce the weight and wall thickness of the bottles, especially for still mineral waters, ice tea, juice, cooking oil, etc.

Nitrogen is used because nitrogen migrates more slowly through PET than water. Water is polar and PET, as a polar material, is not a good barrier. Nitrogen is non-polar and therefore PET can maintain an internal pressure for a long time, despite simultaneous loss of water.

However, not all bottles are suitable for this technology. Flat or oval bottles in particular have the problem that they become round due to the internal nitrogen pressure and lose their original flat or oval shape.

Another problem arises when filling PET bottles: due to the fast-running filling machines, bottles often cannot be filled to the very top because they would spill over. In some filling processes, the displaced volume of a filling lance must be taken into account, in others the foam formation of the filling material. This is an argument in favor of bottles with increased headspace. The effect of the empty headspace is further enhanced by the loss of water. However, bottles with a large unfilled headspace look underfilled and are instinctively rated worse by the end consumer than bottles with a well filled headspace.

OBJECT OF THE INVENTION

The disadvantages of the described prior art give rise to the object of creating an alternative possibility for pressure build-up in a filled, closed bottle, which is cost-effective and additionally provides a well filled headspace.

DESCRIPTION

The stated object is achieved, in the case of a method for filling a plastics container, by the features listed in the characterizing part of claim 1. The dependent claims relate to developments and/or advantageous alternative embodiments.

The invention is preferably characterized in that in a deformation step the container, prior to being closed, is deformed by a mechanical force such that the cross-sectional shape of the container is changed and its volume is thereby increased, and that in a pressure relief step the mechanical force is removed once the container has been closed, as a result of which the volume contraction causes an excess pressure to build up in the closed container, and the liquid-filling height to rise. By the increase in the bottle volume, caused by the deformation step, the container is placed in a prestressed state. Since the plastics container is resilient, after the pressure has been released the container springs back to its original shape as best as possible. However, in this case the filled liquid and the air in the sealed headspace represent a resistance. This causes the container to be pressurized. Through resilient volume contraction, a desired internal pressure can be built up in a targeted manner. The excess pressure makes the bottle firmer to grip and more stable for transport. As with nitrogen-based technology, the weight of the bottle or its wall thickness can be reduced here. The material saving potential is 10-20 wt. %. In addition, the container also has an increased headspace due to the increase in volume. During filling of the deformed container with liquid, the enlarged headspace can accommodate foaming liquid, the volume of the filling lance and overflowing liquid. By relieving the pressure on the container, the head volume is also reduced and the filling level increases. This means that when the container is on the shelf it is well filled and does not appear underfilled to the consumer.

In a preferred embodiment of the invention, the cross-section of the container has a smallest diameter, and in the deformation step the smallest diameter increases. The deformation step allows the volume to be more than doubled if required.

In a further preferred embodiment, the mechanical force is a compressive force and acts on the container in such a way that the smallest diameter increases. This allows the container to be deformed quickly and precisely using sliders on the conveyor belt before filling. The sliders compress the container in a horizontal direction, preferably at the points opposite the smallest diameter.

In a further preferred embodiment, the mechanical force is a tensile force and acts on the container in such a way that the smallest diameter increases. Suction cups can be used to generate the tensile force, which suction cups attach themselves to the outer wall of the container in the region of the smallest diameter and pull the container apart in a horizontal direction.

In a particularly preferred embodiment, the container has an oval cross-section with a main axis with a largest diameter and a minor axis with a smallest diameter, and the mechanical force acts on the main axis as a compressive force or on the minor axis as a tensile force. The oval cross-section can also have the shape of an ellipse. This shape can be expanded particularly well to a circular cross-section. The resilient volume contraction is very suitable for oval containers since, after the pressure relief step, they return to a desired oval shape and do not remain round.

It is particularly preferred if the cross-section of the container is given a substantially circular shape in the deformation step. This gives the container the maximum possible increase in volume.

It has proven to be expedient if the deformation step is carried out before filling the container. This means that the maximum filling volume is available during filling, which makes filling much easier and reliably prevents contamination of the container or production equipment due to liquid overflow.

In a further embodiment of the invention, the pressure relief step is realized by expansion of decorative elements attached to the container surface. This means that the pressure relief can take place not only in the filling system after the mechanical force has been removed, but also slowly, so that the internal pressure does not build up suddenly. In this case, corresponding labels or "sleeves", such as "stretch sleeves", are stretched by the restoring force of the resilient container, which leads to a slower build-up of internal pressure.

Figure 2:
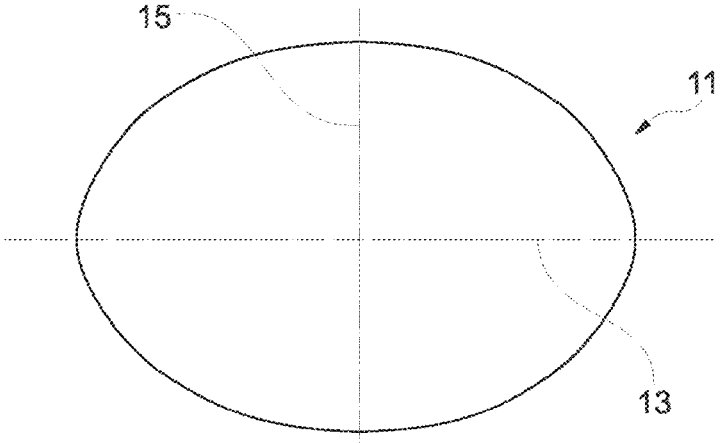
Figure 3:
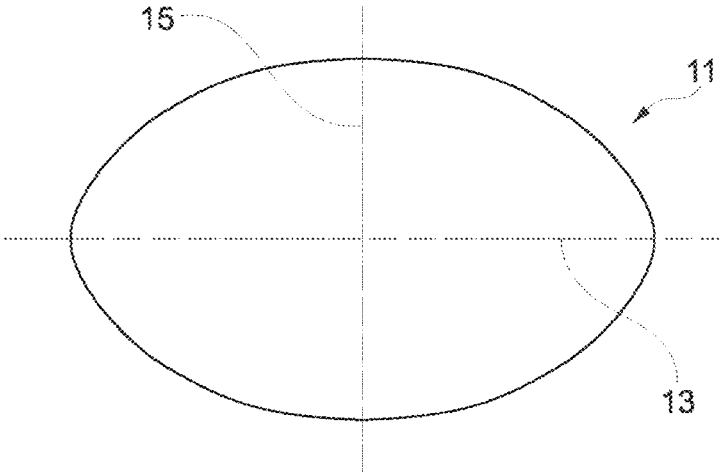
Figure 4:
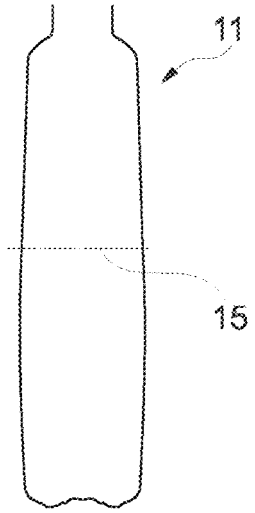
Figure 5:
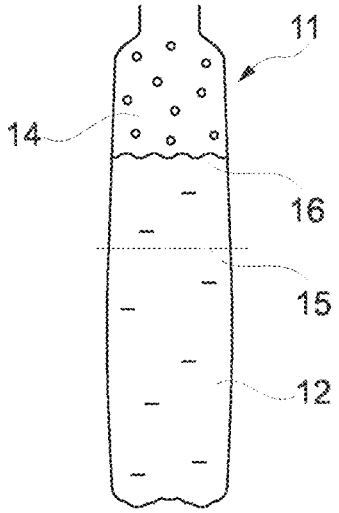
Figure 6:
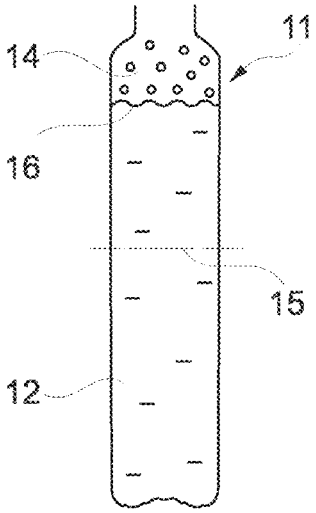

Further advantages and features will become apparent from the following description of an embodiment of the invention with reference to the schematic drawings. In the figures, in a representation that is not to scale:

FIG. 1: shows the cross-section of an oval bottle before a deformation step;

FIG. 2: shows the cross-section of the bottle during the deformation step;

FIG. 3: shows the cross-section of the bottle after a pressure relief step;

FIG. 4: is a side view of the bottle before the deformation step;

FIG. 5: is a side view of the bottle during the deformation step;

FIG. 6: is a side view of the bottle after the pressure relief step, and

Figure 7A:
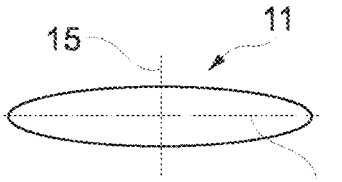
Figure 7B:
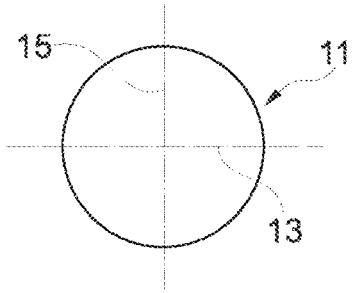
Figure 7C:
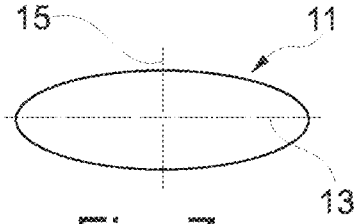

FIGS. 7*a*, 7*b* and 7*c*: are three views for calculating the surface area or volume of a bottle filled according to the method according to the invention.

FIGS. 1 to 4 are a cross-section and a side view of a container, and in particular a bottle. The container or bottle is designated as a whole with the reference sign 11. The bottle preferably has an oval or elliptical cross-section, as this shape is ideal for deforming the bottle. Before the bottle is filled, it is mechanically deformed so that the bottle is brought into an approximately circular shape. If the bottle 11 is filled and closed and then mechanically relieved of pressure again, the filling height increases as a result of the volume reduction, and an increased internal pressure builds up. The principle of elastic deformation is used here, in order that the bottle 11 obtains a larger volume during the filling process and an internal pressure can subsequently build up in the bottle.

The oval cross-section has a main axis 13 with a largest diameter and a minor axis 15 with a smallest diameter. By a mechanical force, the bottle 11 is compressed on the main axis 13 or pulled apart on the minor axis 15. This gives the bottle 11 the cross-section shown in FIG. 2. The force can be applied as a compressive force, for example via two opposing sliders, and can act on the main axis 13. The force can also act as a tensile force, for example via two opposing suction cups which act on the minor axis 15.

After the deformation step, the cross-section has a shape that is as circular as possible, in which the volume of the bottle is significantly increased. A liquid 12 is filled into the deformed bottle 11 with the increased volume. After the bottle is closed, the force is removed in a pressure relief step. The bottle tries to return to its original cross-sectional shape. In doing so, it compresses the liquid 12 and the air 14 in the closed headspace, whereby an internal pressure builds up and the filling height 16 of the liquid 12 rises. This makes the bottle 11 mechanically more stable. The pressure-relieved cross-sectional shape of the filled bottle is shown in FIG. 3. Due to this effect, it is possible to make bottles lighter in weight because the mechanical stability is no longer determined solely by the material or the wall thickness of the bottle. The material saving potential is between 10 and 20%. In addition, the increased volume also creates an increased headspace. This increased headspace can be used during filling to absorb foam generated during filling, to compensate for the volume of the filling lance immersed in the container, or to prevent liquid from spilling over. Due to the pressure relief or the resulting internal pressure, the liquid 12 is pushed upwards and partially fills the headspace. This gives the bottle a filling level that is perceived as positive by the consumer. The excess pressure makes the bottle firmer to grip and more stable for transport. Just as in the case of nitrogen-based technology, the weight of the bottle can be reduced.

FIGS. 7*a* to 7*c* are part of an illustrative example: FIGS. 7*a*, 7*b* and 7*c* show three cross-sections with identical circumferences (U=31.4 cm) but different surface areas. The surface areas were calculated using the formula for calculating the surface area of an ellipse. In order to calculate the volume, a bottle height of 10 cm was assumed. FIG. 7*a* corresponds to the initial cross-section of the bottle 11 before the deformation step. The main axis a has a length of 15 cm and the minor axis b has a length of 2.9 cm. The surface area is 33.9 $cm^2$ and the volume is 339 ml.

If the cross-section is deformed to a circle with a radius of 5 cm, the surface area changes to 78.5 $cm^2$ and the volume is 785 ml. The volume increases by 446 ml due to the deformation. After pressure relief, the cross-section is 53.7 $cm^2$ and the volume is reduced to 537 ml. This reduces the volume by 248 ml, which can serve to create an excess pressure and raise the filling level.

This illustrative example shows how great the potential is to generate large volume differences and thus excess pressures through resilient volume contraction. As a rule, even a small deformation is sufficient to achieve the desired excess pressure.

LIST OF REFERENCE SIGNS

11 container, bottle
12 liquid
13 main axis, largest diameter
14 air
15 minor axis, smallest diameter of the container
16 filling height

The invention claimed is:

1. A method for filling a plastics container, comprising the following method steps:

filling the plastics container with a liquid, and closing the filled plastics container, wherein in a deformation step, the container, prior to being closed, is deformed by a mechanical force such that the cross-sectional shape of the container is changed and its volume is thereby increased and in a pressure relief step, the mechanical force is removed once the container has been closed, as a result of which the volume contraction causes an excess pressure to build up in the container, and the filling height of the liquid to rise.

2. The method according to claim 1, wherein the cross-section of the container has a smallest diameter and in the deformation step the smallest diameter is increased.

3. The method according to claim 1, wherein the mechanical force is a compressive force and acts on the container in such a way that the smallest diameter increases.

4. The method according to claim 1, wherein the mechanical force is a tensile force and acts on the container in such a way that the smallest diameter increases.

5. The method according to claim 1, wherein the container has an oval cross-section with a main axis with a largest diameter and a minor axis with a smallest diameter, and the mechanical force acts on the main axis as a compressive force or on the minor axis as a tensile force.

6. The method according to claim 1, wherein the cross-section of the container is given a substantially circular shape in the deformation step.

7. The method according to claim 1, wherein the deformation step is carried out before filling the container.

8. The method according to claim 1, wherein the pressure relief step is realized by expansion of decorative elements attached to the container surface.

* * * * *